US005186163A

United States Patent [19]

Dye

[11] Patent Number: 5,186,163

[45] Date of Patent: Feb. 16, 1993

[54] COMPRESSION DEVICE

[75] Inventor: John F. Dye, Bridgewater, Mass.

[73] Assignee: The Kendall Company, Mansfield, Mass.

[21] Appl. No.: 797,680

[22] Filed: Nov. 25, 1991

[51] Int. Cl.[5] ..... A61H 7/00; A61H 1/00

[52] U.S. Cl. ..... 128/64; 128/24.2; 128/38

[58] Field of Search ..... 128/24.1, 24.2, 24 R, 128/38, 39, 40, 64, 65

[56] References Cited

U.S. PATENT DOCUMENTS

| | | | |
|---|---|---|---|
| 3,403,673 | 10/1968 | MacLeod | 128/40 |
| 3,865,103 | 2/1975 | Folman | 128/64 |
| 3,993,053 | 11/1976 | Grossar | 128/24.1 X |
| 4,702,232 | 10/1987 | Gardner et al. | 128/64 |
| 4,841,956 | 6/1989 | Gardner et al. | 128/64 |
| 4,865,020 | 9/1989 | Bullard | 128/64 |
| 4,941,458 | 7/1990 | Taheri | 128/64 |

*Primary Examiner*—Robert A. Hafer
*Assistant Examiner*—Brian E. Hanlon
*Attorney, Agent, or Firm*—Alvin Isaacs

[57] ABSTRACT

This invention relates to venous blood flow in a patient's limb which is promoted by repeating a cycle of sequentially applying compressive pressures against a patient's limb through a flexible, pressurizable sleeve having pressure chambers progressively arranged along the limb in relation to the patient's heart. Specifically, the pressure chambers from the distal to proximal are pressurized until they are at their appropriate pressures so as to collapse the veins in the limb. At the end of the most proximal compression, a foot chamber is compressed at a substantially higher pressure than the other chambers to force a bolus of blood from the foot into the limb causing the collapsed veins to open, the support of the chambers minimizing distention of the veins and enhancing the transmitting of blood up the limb.

17 Claims, 2 Drawing Sheets

COMPRESSION DEVICE

BACKGROUND OF THE INVENTION

1. Field of Invention

The present invention relates to inducing flow of venous blood in a patient's limb from the lower portion of a limb to an upper portion of the limb proximal the patient's heart relative the lower portion.

2. Prior Art

In U.S. Pat. No. 4,702,232 by Gardner and 4,841,956, a division thereof, there is recited a method of a pump-actuating sequence which characterizes normal walking. This is accomplished by sequentially applying pressure to the foot, the proximal calf and then to the distal calf in repeating cycles.

There is a definite disadvantage in the prior art method of inducing venous flow of the blood by first compressing the foot, in that a sharp impact has to be made at the sole of the foot so the blood from the foot is forced into very compliant leg veins. Sufficient blood is forced from the foot to form a bolus of blood. As the bolus of blood moves up the veins in the limb its bulk dilates the veins beyond there normal elasticity. This excessive dilation may cause damage to the walls and lining of the veins. Additionally, the energy to move the blood up the limb is absorbed by dilating the veins so that velocity decreases as the bolus moves up the limb. Because of this diminshed velocity, only a slight increase in velocity may be seen at the knee and little or none may be seen at the thigh. This not only minimizes the systemic effectiveness of this kind of compression, but may cause damage to the veins of the patient because of the increase in the distention of the veins.

The above prior art method may also result in potential deep vein thrombosis and pulmonary embolism due to damage done to the lining of the veins.

The conditions created by the prior art are not conducive to healing of a patient or the prevention of deep vein thrombosis (DVT) and should be avoided.

The present invention provides a more advanced method in obtaining effective and excellent enhanced transmitting of blood through the venous system. This advanced method minimizes excessive distention of the veins and any potential for deep vein thrombosis and pulmonary embolism which the prior art method has not.

SUMMARY OF THE INVENTION

The present invention method achieves the following objects by repeating a cycle of sequentially applying compressive pressures against a patient's limb through means of a flexible, pressurizable sleeve having pressure chambers and which encloses the limb from the lower portion to an upper portion of the limb proximal the patient's heart. The pressure chambers are sequentially pressurized starting distally and continuing to the most proximal extent, until each are at their appropriate pressures. At the end of this compression, a foot chamber is pressurized at a substantially higher pressure than the other chambers. The pressure exerted at the sole of the foot forces a bolus of blood from the foot into the limb causing the veins in the limb to progressively open to their normal level of dilation, enhancing blood flow up the limb.

An object of the present invention is to provide a method to stimulate fibrinolytic activity, provide more effective transmitting of blood flow up the leg, and minimize distention of the venous blood vessel walls.

Another object of this invention is to provide a method to minimize the micro-fracturing of the walls and lining of the veins, thus, minimizing or eliminating the release of clotting agents into the blood stream.

A further object of this invention is to provide a method to reduce potential deep vein thrombosis and pulmonary embolisms.

DESCRIPTION OF THE PREFERRED EMBODIMENT

Figure 1:
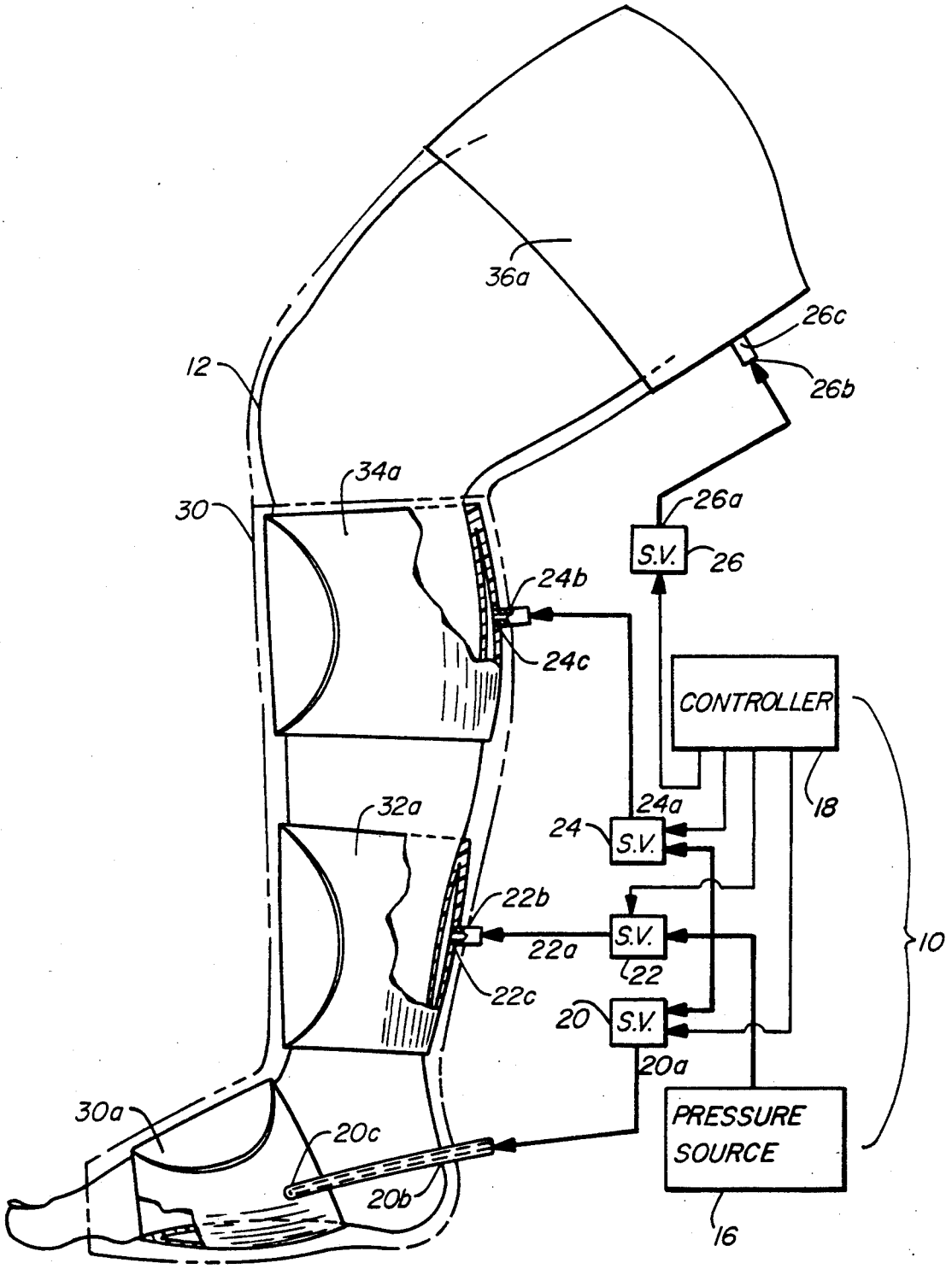
FIG. 1 is a side elevation of a patient's limb illustrating one embodiment which has a sleeve having pressure chambers at the foot, ankle, calf and thigh to which a compressive device has been applied.

Referring to FIG. 1 and to briefly describe a simplified version of the compressive device, the compression device 10 is seen as supplying sequential compressive pressures to a leg 12 or legs of a patient. The device 10 includes a pressure source 16, means for controlling pressure 18, and solenoid valves, 20, 22, 24 and 26 for distribution of pressure to a pressure sleeve 30 encircling the patient's leg 12. The source 16 supplies the pressures illustrated in FIG. 2, as shown in FIG. 1, at output ports 20*a*, 22*a*, 24*a* and 26*a* respectively. The output ports 20*a*–26*a* are connected through flexible tubes 20*b*, 22*b*, 24*b*, and 26*b* and are in fluid communication with input ports 20*c*, 22*c*, 24*c*, and 26*c* located in the pressure chambers of the sleeve 30.

FIG. 1 illustrates that the pressure chambers are connected to the pressure generator 16 through solenoid valves 20, 22, 24, and 26.

Also as seen in FIG. 1, the supply of pressure from the pressure source 16 is controlled by a controller 18, which controls the application, timing and sequence of the fluid to the chambers in the compression sleeve 30.

The compression sleeve 30 as shown in FIG. 1 is wrapped around at least one of the patient's legs 12. The sleeve has at least two pressure chambers. In the preferred embodiment as shown in FIG. 1, four pressure chambers are provided, namely foot chamber 30*a*, ankle chamber 32*a*, calf chamber 34*a* and thigh chamber 36*a*. The sleeve is of the same type shown in U.S. Pat. No. 4,396,010, of Arkans, and other patents referenced therein.

Figure 2:
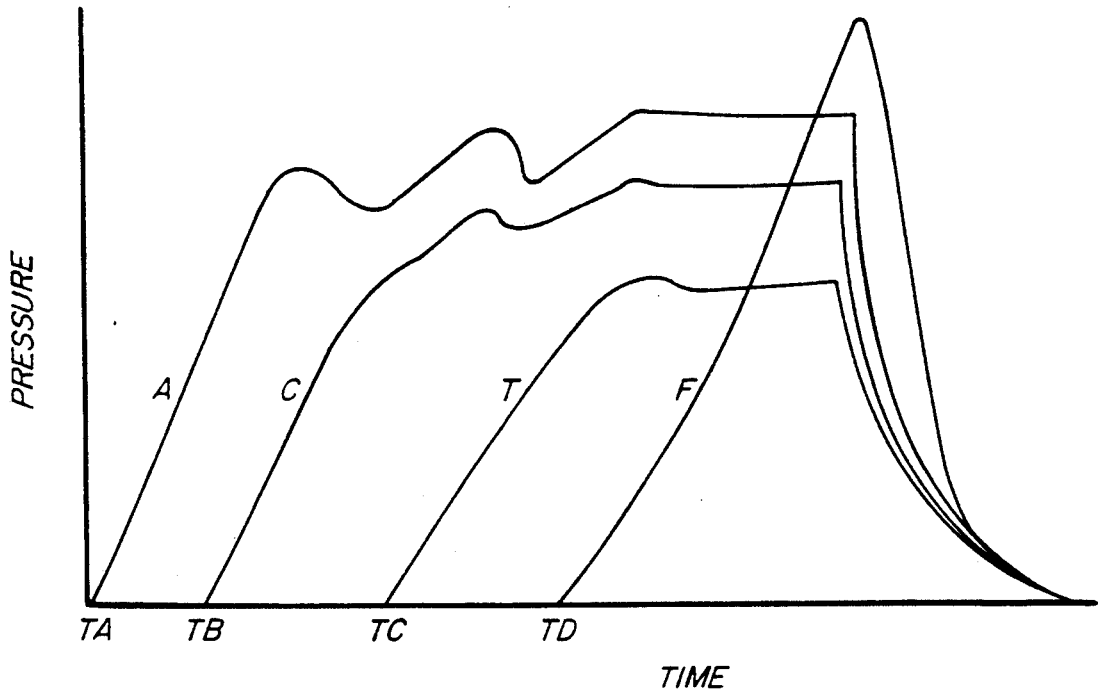
FIG. 2 is a timing diagram of the pressure cycles that occur sequentially in the repeating pressure cycles.

Referring again to FIG. 1, the pressure source and controller function is to cyclicly generate pressure pulses to its output ports 20*a*–26*a* in the time sequence shown by the wave-forms of FIG. 2. As seen by FIG. 2, the pressure cycles commence at time TA when pressure pulse A is applied to port 22*a* and the ankle chamber 32*a* is pressurized. At time TB, pressure pulse B is applied to port 24*a* and the calf chamber 34*a* is pressurized. At time TC, pressure pulse C is applied to port 26*a* and the thigh chamber 36*a* is pressurized. At the end of the thigh compression, when the ankle, calf and thigh have each reached their appropriate pressure, at time TD, a significantly higher pressure pulse D is applied to port 20*a* and the foot chamber 30*a* is pressurized. At the end of the foot cycle, chambers 30*a*–36*a* are vented to the atmosphere after which cooling may optionally be applied. At the end of the cooling pulse, the entire sequence is repeated commencing with pressure pulse A.

From the foregoing description it will thus be seen that the present invention provides a novel sequence for sequentially applying compressive pressures against a patient's limb through means of a flexible, pressurizable sleeve having pressure chambers, which sleeves encloses the limb from the lower portion to an upper portion of the limb proximal the patient's heart. The pressure chambers are sequentially pressurized starting respectively at the distal ankle, calf and then the proximal thigh, until they are at their appropriate pressures. Due to the compressive pressure exerted at the ankle, calf and thigh, the veins in the respective areas of the limb compress or reduce in size. At the end of the thigh compression, the foot chamber is pressurized at a substantially higher pressure than the other chambers. This pressure forces a bolus of blood from the foot into the limb, causing the compressed veins in the ankle, calf and thigh to open, thereby minimizing distention of the veins and enhancing the flood of blood up the limb.

The present invention method by applying pressure sequentially in a repeating cycle, distally starting from the ankle and moving progressively proximally to the calf and thigh, compresses the veins in each portion of the leg. As the pressure is applied to each chamber respectively, the veins compressed in the limb tend to collapse. This means the veins are not in distention but generally are in a reduced or relaxed state. Once the ankle, calf and thigh chambers have reached their respective pressures, which may range from at least 45 mmHg at the ankle, at least 35 mmHg at the calf, and at least 30 mmHg at the thigh, a higher pressure ranging from 45 mmHg to 150 mmHg is then applied to the foot chamber at the sole of the foot. Although the pressure at the foot may range from 45 mmHg to 150 mmHg, it has been determined that the preferred pressure to be applied at the foot is on the order of about 60 mmHg. The pressure applied at the sole of the foot compresses the foot and forces a bolus of blood from the foot into the limb opening the compressed veins in the ankle, calf and thigh and furthering the transmitting of the blood up the limb. For purposes of this invention the sole of the foot is defined as being essentially between the ball and heel of the foot. The force of the pressure exerted at the foot progressively opens the veins in the ankle, calf and thigh, while the compressive force being applied to the ankle, calf and thigh tend to keep the respective veins stable. This stabilization minimizes distention of the veins and assists in transmitting blood up the leg. This method of applying pressure at the foot in the reverse order of that applied by prior art provides a method that not only stimulates fibrinalytic activity, but also provides more effective flow of blood up the leg, minimizes distention of the venous blood vessel walls, and does not damage the walls or lining of the veins, thus minimizing the release of clotting agents into the blood. The pressure applied to the foot by this method permits the velocity of the blood to be maintained up the limb into the trunk.

Furthermore, this invention provides a method to reduce potential deep vein thrombosis and pulmonary embolisms because the present method does not cause micro-fracturing of the veins or damage to the lining of the veins. Normally, when micro-fracturing occurs in the veins clotting agents are released from the lining and enter the blood stream to further complicate the patient's condition. The present method minimizes micro-fracturing of the veins due to the limited dilation of the veins. Accordingly, fewer clotting agents are released into the blood stream, and, in turn fewer venous thrombi or pulmonary embolisms may occur.

In U.S. Pat. No. 4,702,232 by Gardner, sequential pressure is applied starting at the foot, with a sharp impact of pressure, the proximal calf and then with the distal calf being compressed. The veins in the limb from the foot to the distal calf collapse progressively causing a wave action to be generated in the veins. This wave action increases distention of the veins, thereby causing micro-fractures to appear in the walls and lining of the veins. In conjunction with the wave action, as the blood moves up the veins due to the velocity created by the pressure at the foot, further damage occurs to the walls of the veins. This damage is also in the form of micro-fracturing of the walls caused by a further distention of the veins. By micro-fracturing the walls and causing damage to the lining of the veins, the normal clotting agents are released into the blood stream, causing a potentially higher risk of DVT to a patient.

In an alternate method contemplated by this invention, the gradation in compressive pressure from the ankle proximally to the thigh is provided by a garment encircling the leg rather than by a compressible sleeve, the garment being used in combination with means such as heretofore described for applying compressive pressure at the sole of the foot.

Preferably, the garment so employed is a compression stocking such as those commercially available from The Kendall Healthcare Products Company, a division of The Kendall Company, assignee of this invention. Stockings of this description are disclosed, for example, in the following U.S. Pat. Nos. all of which are assigned to The Kendall Company: 3,874,001; 3,889,494; 4,015,448; 4,021,860; 4,027,667; 4,069,515; 4,180,869; 4,424,596; 4,513,740; and 4,745,917. In general, these stockings, which per se comprise no part of the invention, will provide a pressure gradient decreasing progressively up the leg. By way of illustration, the pressure exerted will be at least 18 mmHg at the ankle region, at least 14 mmHg at the calf and at least 11 mmHg at the thigh.

In any case, the particular pressures exerted may vary over a wide range in accordance with this invention and the selection of the desired ranges will be a matter of choice within the expected judgement of the skilled clinician based upon the needs of the individual patient. Moreover, the preferred stockings will be relatively inelastic or possess a high modulus of elasticity to prevent dilation of the blood vessels.

As heretofore, mentioned, the compression garment, e.g. a stocking of the foregoing description, is used in this embodiment of the invention in combination with means for applying pressure at the sole of the foot.

With reference to FIG. 1, the means for applying pressure at the sole of the foot will comprise a sleeve 30 having a single chamber 30*a* at the foot. In this modification of the compressive device shown in the drawing, air from pressure source 16 is transmitted to foot chamber 30*a* through a flexible tube 20*b*. Alternatively, the device 10 of FIG. 1 may contain a modification whereby controller 18 by activating a suitable switch can provide compressive air to all the chambers 30*a*–36*a* or only to chamber 30*a*. Accordingly, with this modification of the controller device 10 may at the election of the user function to provide compressive fluid to the sleeve for both embodiments of this invention.

In use, the stocking is placed on the limb and thereafter in a timed sequence of alternating compression and non-compression cycles, a significantly higher pressure is applied to a pressure chamber at the sole of the foot so as to compress the veins in the foot, forcing a bolus of blood into the limb opening the veins, which are being compressed by the stocking, in the ankle, calf and thigh and assisting in the transmitting of blood up the limb. As previously stated, the sole of the foot is considered to be essentially between the ball and heel of the foot.

The force of the pressure exerted at the foot progressively opens the veins in the ankle, calf and thigh, while the compressive force, applied by the stocking, to the ankle, calf and thigh tend to keep the respective veins stable. This stabilization minimizes distention of the veins and assists in transmitting blood up the leg. This method like the present invention method also provide not only stimulation of fibrinolytic activity, but provides more effective transmitting of blood up the leg, minimizes distention of the venous blood vessel walls, and does not cause damage to the walls or lining of the veins, thus, minimizing the release of clotting agents into the blood. This method also permits the velocity of the blood to be maintained up the limb into the trunk, thus making sure sufficient blood is supplied to the heart.

While the latter embodiment has been described with reference to the pressure garments as being a stocking, as heretofore alluded to, the pressure garment may take other forms. For example, it may be in the form of a sheet material which can be wrapped around the leg and then removably secured by known fastening means such as VELCRO, hooks, straps, repositionable adhesive tapes, and the like.

In a third alternate embodiment of this invention, the pressure device as shown in FIG. 1 may be used in combination with a compression garment as described in the second-mentioned embodiment having a pressure gradient decreasing proximally, the difference being, that a uniform sequential pressure is provided in the ankle, calf and thigh chambers 32*a*, 34*a* and 36*a* respectively, rather than a pressure gradient which decreases proximally. In other words, the pressure gradient is provided by the stocking or other garment rather than by the elongated pressure sleeve, the pressure at the ankle, calf and thigh being the function of the pressure exerted in the ankle, calf and thigh chambers in combination with the pressure exerted by the underlying pressure garment.

U.S. Pat. No. 5,022,387 issued Jun. 11, 1991 to James H. Hasty and assigned to The Kendall Company, assignee of the instant invention, relates to a device for applying compressive pressures against a patient's limb comprising the combination of an antiembolism stocking as previously discussed and a sequential compression device of known description for applying compressive pressure which decreases from the lower to the upper limb.

The third-named alternate embodiment of this invention described above differs from the Hasty Patent in two significant aspects: (1) the application of pressure to the sole of the foot at the end of the pressure cycle to the limb to enhance blood flow up the limb; and (2) applying a uniform pressure to the ankle, calf and thigh rather than a pressure gradient.

It will be appreciated that various changes may be made without departing from the scope of the invention herein contemplated.

For example, it is visualized that an antiembolism stocking as heretofore described in combination with a compression device providing uniform pressures to the ankle, calf and thigh sequentially or simultaneously, which device has no foot chamber, will provide significant advantages over the current state of the vascular compression art.

This last-mentioned concept will be described in detail and claimed in an application (P.F. 1722) to be filed subsequently.

Since certain changes may be made without departing from the scope of the invention herein contemplated, it is considered that all matter described in the foregoing specification or shown in the accompanying drawing shall be taken as being illustrative and not in a limiting sense.

What is claimed is:

1. In the method of promoting venous blood flow in a patient's limb, the limb being a leg having a foot having a sole essentially between the ball and the heel of the foot, the method having repeating compression cycles of applying compressive pressure to the lower and upper portions of the limb and decompression cycles where the compressive pressure is released;

the improvement wherein at the end of each compression cycle, a significantly higher pressure is applied at the sole of the foot whereby to compress the veins in the foot and thereby provide enhanced blood flow up the limb.

2. A method as defined in claim 1 wherein the compressive pressure to the lower and upper portions of the limb is applied sequentially from the ankle region of the limb to the thigh region.

3. A method as defined in claim 1 wherein the compressive pressure to the lower and upper portions of the limb is applied so as to provide a pressure gradient which decreases from the lower portion of the limb distal to the heart to the upper portion of the limb proximal to the heart.

4. A method as defined in claim 1 wherein compressive pressure is applied to the limb by the steps of enclosing the limb with an elongated pressure sleeve having at least one pressure chamber and exerting fluid pressure within said at least one pressure chamber to apply the compressive pressure.

5. A method as defined in claim 4 wherein the pressure sleeve further has a pressure chamber at the sole of the foot and the pressure applied at the sole of the foot is by the step of introducing a fluid within the foot chamber to exert compressive pressure to the sole of the foot.

6. A method as defined in claim 5 wherein the pressure sleeve has a plurality of separate fluid pressure chambers progressively arranged longitudinally along the sleeve from a lower portion of the limb to an upper portion of the limb proximal the patient's heart.

7. A method as defined in claim 4 including the step of encircling the limb with a pressure garment prior to applying the elongated pressure sleeve to the limb, whereby the pressure applied against the limb is provided by a combination of the pressure sleeve and the pressure garment the pressure garment having a pressure gradient decreasing progressively up the leg so that the greater pressure exerted by the pressure garment is in the ankle region of the limb.

8. A method as defined in claim 7 wherein the pressure garment is a stocking.

9. A method of promoting venous blood flow in a patient's limb, the limb being a leg having a foot having a sole essentially between the ball and the heel of the foot, which method comprises repeating cycles of application of pressure against a patient's limb, the application of pressure in each cycle comprising the steps of:

applying pressure sequentially to pressure chambers progressively arranged along the limb from a lower portion of the limb to an upper portion of the limb; and after the pressure chambers from said lower portion to the upper portion have reached their appropriate pressures, applying, a significantly higher pressure to a pressure chamber at the sole of the foot so as to compress the veins in the foot whereby to provide enhanced flow of blood up the limb.

10. A method as defined in claim 9 wherein the pressure is applied to the pressure chambers by introducing a fluid to expand each of the chambers and thereby apply compressive pressure to the limb.

11. A method as defined in claim 10 wherein the fluid is air.

12. A method as defined in claim 10 wherein the pressure chambers progressively arranged along the limb comprise, in order, an ankle chamber, a calf chamber and a thigh chamber.

13. A method as defined in claim 12 wherein the fluid is introduced into the chambers to provide a pressure gradient decreasing proximally from the ankle chamber to the thigh chamber.

14. A method of promoting venous blood flow in a patient's limb, the limb being a leg having a foot having a sole essentially between the ball and the heel of the foot, by applying compressive pressure to the limb, comprising the steps of:

covering the limb of a patient from a lower portion of the limb to an upper portion of the limb proximal the patient's heart with a pressure garment providing a pressure gradient to the limb decreasing proximally from the lower portion to the upper portion; and applying repeating compression cycles to the foot to provide, in each compression cycle, a significantly higher pressure at the sole of the foot so as to compress the veins in the foot whereby to enhance blood flow up the limb.

15. A method as defined in claim 14 wherein the pressure garment is a stocking.

16. A method defined in claim 15 wherein the stocking is substantially inelastic or possesses a high modulus of elasticity to prevent dilation of the blood vessels.

17. A method as defined in claim 15 wherein the pressure is applied to the sole of the foot during each pressure cycle by introducing a pressure providing fluid into a pressure chamber at the sole of the foot and thereafter expelling the fluid at the end of each pressure cycle.

* * * * *